United States Patent [19]

Sedan

[11] Patent Number: 4,515,402

[45] Date of Patent: May 7, 1985

[54] GOLF BALL RETRIEVER

[76] Inventor: Jack D. Sedan, 245 Portola Rd., Carmel Woods, Calif.

[21] Appl. No.: 519,281

[22] Filed: Aug. 1, 1983

[51] Int. Cl.[3] ..... A63B 47/02

[52] U.S. Cl. ..... 294/19.2; 273/162 E

[58] Field of Search ..... 294/1 R, 19 R, 19 A, 294/99 R; 273/32 B, 32 F, 162 R, 162 D, 162 E, 162 F

[56] References Cited

U.S. PATENT DOCUMENTS

| | | | |
|---|---|---|---|
| 2,110,640 | 3/1938 | Aldrich . | |
| 2,482,294 | 9/1949 | Sandor | 294/19 A |
| 2,523,942 | 9/1950 | Ciambriello | 294/19 A |
| 3,058,767 | 10/1962 | Baker | 294/19 A |
| 3,219,083 | 11/1965 | Asquith . | |
| 3,239,264 | 3/1966 | Dupont | 294/19 A |
| 3,520,569 | 7/1970 | Anderson | 294/19 A |
| 3,614,149 | 10/1971 | Clark | 294/19 A |
| 3,749,407 | 7/1973 | Prochnow | 294/19 A X |
| 3,922,026 | 11/1975 | Schweitzer | 294/19 A |
| 4,077,659 | 3/1978 | Sievers | 294/19 A |
| 4,180,288 | 12/1979 | Sievers | 294/19 A |
| 4,310,189 | 1/1982 | Nihra | 294/19 A |

FOREIGN PATENT DOCUMENTS

| | | | |
|---|---|---|---|
| 216731 | 6/1924 | United Kingdom | 294/19 A |

*Primary Examiner*—Johnny D. Cherry

*Attorney, Agent, or Firm*—Nilsson, Robbins, Dalgarn, Berliner, Carson & Wurst

[57] ABSTRACT

A golf ball retriever incorporates a looped structure to hold the golf ball for retrieval and structure to extend the looped structure from a golf club. The extending structure defines an opening for a golf club head and an opening for a golf club shaft. It includes an elongated arm between the looped structure and the golf club head opening and another elongated arm between the golf club head opening and the golf club shaft opening. The opening for the golf ball is deformable for grasping the ball, and such grasping is facilitated by a deformable extension of the golf ball opening substantially in the shape of a slot. The golf ball retriever is integrally formed of a semi-rigid plastic material.

19 Claims, 4 Drawing Figures

GOLF BALL RETRIEVER

FIELD OF THE INVENTION

The invention pertains to the field of golf ball retrievers.

BACKGROUND OF THE INVENTION

Retrieving golf balls from hazards such as mud, water and foliage is an ever-present problem for golfers. Therefore, it is not surprising that substantial effort has been directed toward the development of devices to retrieve golf balls from such hazards. The problem areas and the difficulties in addressing them are evident in prior efforts.

Nihra, U.S. Pat. No. 4,310,189, Anderson, U.S. Pat. No. 3,520,569 and Clark, U.S. Pat. No. 3,614,149 reveal varied approaches to structure for gripping or retaining a golf ball in a retriever. Nihra adopts structure having the shape of a partial donut, made from an aluminum rod, formed with gripping embossments along the inside of the structure. Such embossments can then grip the ball when the structure is passed over the ball.

Anderson provides small resilient gripping members about, e.g., metallic wire generally forming a circle or partial circle. The gripping members then are intended to grip the ball as the structure they are on, is passed over the ball. Alternatives to the resilient gripping members in Anderson, are triangular indentations in the nature of crimps along the wire, and, also, cone-shaped inwardly facing protrusions from a ring structure.

The ball-holding structure in Clark emphasizes mere retaining rather than gripping. According to one form, Clark provides a slot along a rake head to support a ball and a ring on the head about the slot area to retain the ball in the slot. In another form, again in structure that can alternatively perform as a rake head, Clark provides a rod structure bent to form an elongated inner opening to hold a golf ball.

Another aspect of the golf ball retriever situation concerns the desire to achieve sufficient reach for the retriever while attempting to limit the storage size of the retriever and the weight of the retriever. Nihra, Anderson and Clark are also illustrative of this aspect.

Nihra, as for specifics, discloses the use of telescopically assembled tubing. Anderson also suggests a telescopic handle which, to facilitate effective operation, is at an angle from the plane of the circle or partial circle relating to the gripping structure. Clark suggests lightweight tubular material such as an aluminum alloy or the like and, again, telescoping. In addition, the handle is rotatable relative to the rake-ball retaining structure to provide the alternative raking-golf ball retrieving uses and, also, for storage.

Asquith, U.S. Pat. No. 3,219,083 is of some, limited peripheral interest in disclosing a combination golf club carrier, ball carrier and carrier for other golf accessories. Aldrich, U.S. Pat. No. 2,110,640 is similarly of tangential interest in providing a utility implement made of wire and particularly adapted for cooking. The implement includes tine elements at one end, a ring for use in opening bottles near the middle and a socket for a temporary handle such as a stick cut from shrubbery or undergrowth toward the other end.

The present invention provides a golf ball retriever formed to particularly interact with a golf club, for extension of the retriever from the golf club. Along with this, it provides structure for gripping a golf ball for retrieval with a light touch while the retriever is extended from a golf club.

SUMMARY OF THE INVENTION

In accordance with one aspect of the invention, a golf ball retriever includes: a looped structure to hold the golf ball for retrieval; and structure for extending the looped structure from a golf club.

In accordance with another aspect of the invention, a golf ball retriever includes: a looped structure to hold the golf ball for retrieval; an elongated structural member attached to the looped structure; wherein the looped structure and the member define a deformable opening for the golf ball and a deformable extension of the golf ball opening.

In accordance with yet another aspect of the invention, a golf ball retriever includes: a looped structure to hold the golf ball for retrieval; structure defining a first opening to receive a golf club; a first elongated arm between the looped structure and the first opening; structure defining a second opening to receive the golf club; and a second elongated arm between the first opening and the second opening In an embodiment incorporating additional, more detailed features of the invention: the deformable extension of the golf ball opening substantially has the shape of a slot; the retriever is integrally formed of a semi-rigid plastic material; and the opening for the ball and the two openings for the golf club are substantially co-planar and substantially in alignment with one another.

DETAILED DESCRIPTION

Figure 1:
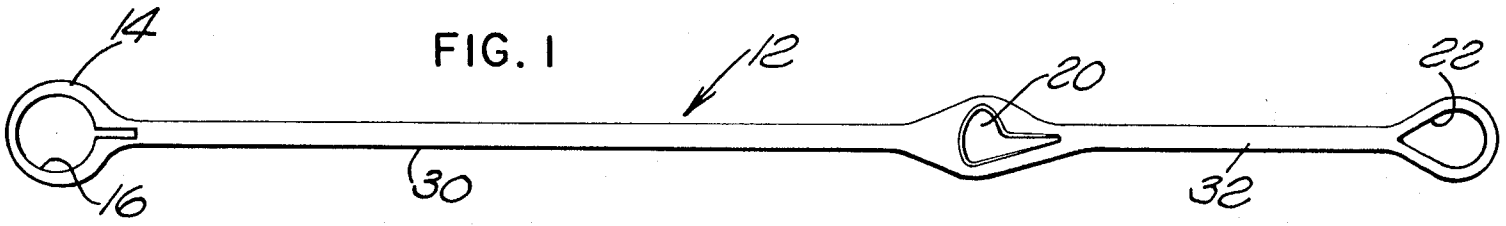
FIG. 1 is a plan view of a golf ball retriever in accordance with the invention.
Figure 2:
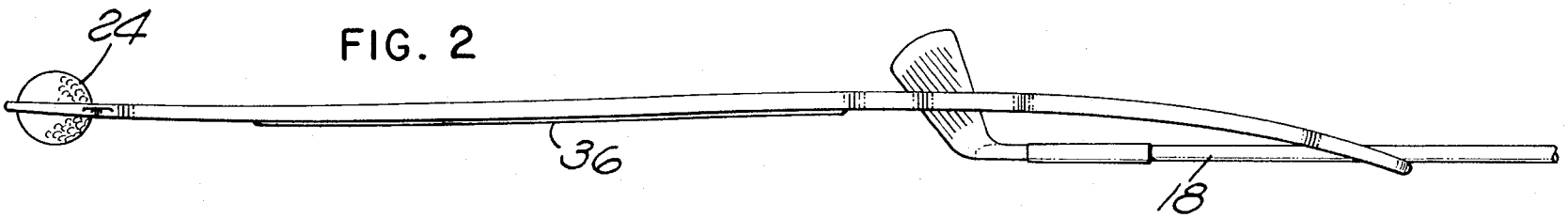
FIG. 2 is an elevational view of the golf ball retriever of FIG. 1 extending from a golf club and grasping a golf ball.

Referring to FIG. 1, and by way of introduction, a golf ball retriever 12 is integrally formed of a plastic material by molding the material into the desired form. A looped structure 14 defines an opening 16 for the golf ball, as is shown in FIG. 2, in which the retriever is shown in position, extending from a golf club 18. There is a club head opening 20, particularly shaped to fit the heads of the long irons, such as the one iron through the five iron, and a club shaft opening 22, for the shaft of the club.

Addressing the retriever in more detail, it is apparent that the retriever is formed with the golf ball opening 16, the club head opening 20 and the club shaft opening 22 lying in substantially the same plane—i.e., in a co-planar orientation. In addition, the retriever is formed with the three openings substantially in alignment with one another. It might be noted that if, however, in the particular molding process, this alignment is not exact, such will not significantly detract from the effective operation of the retriever.

The plastic material which is chosen for the retriever gives the parts of the retriever a semi-rigid character. For example, the rigidity is substantially less than would typically be the case if the retriever were made of a typical wood, steel or other metallic material. On the other hand, the rigidity is substantially greater than would be the case if the retriever were made of rubber of the sort that is used in, for example, tire treads.

The opening 16 which is defined by the looped structure 14 that grasps the golf ball 24, is a deformable opening. This is of significance in the grasping action when the looped structure is placed over the ball and slipped down around the ball. The golf ball opening, thus, is molded in the shape of a circle with a diameter slightly smaller than the 1.62-inch maximum diameter of the typical American golf ball. Where golf balls having other sizes, e.g., the smaller size golf ball used in Great Britain, are employed, the size of the golf ball opening, of course, will differ.

Figure 4:
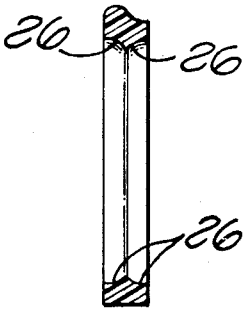
FIG. 4 is a cross-sectional view taken along the line 4—4 of FIG. 3.

After the retriever, including the looped structure 14, is molded, the inside of the golf ball opening 16 is finished further to increase, yet further, the capability of the retriever to pick up a golf ball with a light touch. This finishing is most conveniently accomplished by putting a conventional finishing compound on a golf ball, passing the golf ball from the underside of the retriever into the golf ball opening 16 so that it is somewhat less than half way through the opening, and turning the golf ball in the opening. Then, the analogous procedure is followed but from the top of the opening. A slightly rippled inwardly facing surface 26 to reflect this finishing, is shown in FIG. 4.

Figure 3:
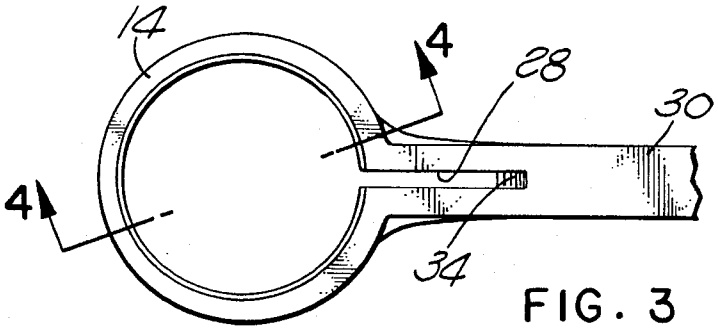
FIG. 3 is a broken-away plan view showing the underside of part of the golf ball retriever of FIG. 1.

The deformable character of the golf ball opening 16 is enhanced by a similarly deformable, generally slot-shaped opening 28 (FIGS. 1 and 3) which extends from the golf ball opening 16. The golf ball opening and the slot-shaped extension have somewhat the shape of a keyway. As is apparent from the drawings, the slot-shaped opening extends a distance along the elongated arm 30 of the retriever 12 which is between the golf ball opening 16 and the club head opening 20. The other arm 32 of the retriever, of course, is between the club head opening 20 and the club shaft opening 22. With regard to the slot-shaped opening 28, a ramp 34 from the underside surface to the top surface of the retriever is merely a result of convenience in molding and is not of any substantial functional significance.

The semi-rigid character of the retriever 12, as indicated, by way of contrast, is considered to be of functional significance. This is apparent by reference to FIG. 2 which shows the typical elevational shape of the retriever when on and extending from a golf club while grasping a golf ball. Thus, it is apparent that the arm 32 which runs along the golf club shaft is sufficiently bendable (flexible) to permit the retriever to fit on the golf club and be effectively supported by the golf club and also to generally follow the shaft of the golf club when the retriever is in position. The somewhat bendable character of the arm 30 between the golf ball hole 16 and the club head hole 20 is also evident in FIG. 2 and is adapted to achieve the lightness of touch desirable for the retriever in grasping a golf ball. It might be noted that a raised portion 36 which runs down the middle of this arm along part of the arm exemplifies structure that can be employed to adjust bendability. Such a raised portion, as well as other portions of the retriever, can also be embossed with decorative designs to enhance the visual appeal of the retriever.

The total length of the retriever, of course, can be varied. Typical dimensions which have been found to be effective are: distance between the end of the slot-shaped opening 28 (nearest the club head opening) and the club head opening (edge nearest the slot-shaped opening)—about 17 inches; distance between club head opening 20 (edge nearest the club shaft opening) and club shaft opening 22 (edge nearest the club head opening)—about 7 inches; length of slot-shaped opening 28—about 1 inch.

In use, the retriever can be carried in the golfer's golf bag—if desired, with the club shaft opening 22 about the shaft of a club. Then, to retrieve a golf ball, e.g., in the water, mud, foliage or other such hazard, the golf club can be pulled from the bag with the retriever, the head of the club can be fitted in the club head opening 22, and the golfer can hold the grip of the golf club (not shown) in one hand and extend the retriever so that the golf ball opening 16 is over the ball. The looped structure 14 defining the opening can then be slipped over the golf ball with a light touch, grasping the ball, and the ball can be retrieved.

A wide variety of plastic, semi-rigid materials can be conventionally employed in molding the retriever. An example of one such material which has been found satisfactory is a mixture of 99 parts of a resin material sold by Reichhold Chemical Co. under the name Flexible Polyester Resin No. 32-300 and and part of a hardener material sold by same company under the name Catalyst 46-709. In forming the retriever, effective degasing is considered to be particularly desirable—including, for example, de-gasing of the liquid material before it is molded into a structure and further de-gasing of the molded structure.

It should be apparent to those skilled in the art that many variations and modifications may be made in the embodiment which has been described without departing from the scope or spirit of the invention. Merely by way of example, it is conceivable that widened elongated structure could be provided with downward extensions from the underside to provide an effective grip on a golf club shaft which can then support the retriever. Accordingly, the scope hereof shall not be referenced to the disclosed embodiment, but on the contrary shall be determined in accordance with the claims as set forth below.

What is claimed is:

1. A golf ball retriever, comprising:

a looped structure to hold the golf ball for retrieval defining an opening to receive the ball; and means for extending said looped structure from a golf club generally long the direction of the shaft of the club to position the looped structure substantially away from an end of the club and substantially extend the reach of the club for retrieval;

said extending means defining an opening to receive the golf club to support the retriever for said extending;

said extending means opening being oriented to pass through said extending means substantially perpendicularly to said extending direction, in substantially the same orientation as said opening to receive the ball.

2. A golf ball retriever as defined in claim 1 wherein said extending means further defines a second opening to receive the golf club concurrently with said other extending means opening.

3. A golf ball retriever as defined in claim 2 wherein said openings defined by said extending means are substantially co-planar.

4. A golf ball retriever as defined in claim 2 wherein said opening defined by said looped structure and said openings defined by said extending means are substantially co-planar.

5. A golf ball retriever as defined in claim 2 wherein said second opening to receive the golf club is oriented through said extending means substantially perpendicularly to said extending direction, in substantially the same direction as said opening to receive the ball.

6. A golf ball retriever as defined in claim 1 wherein said extending means includes an elongated arm for said extending.

7. A golf ball retriever as defined in claim 1 wherein said extending means is formed to extend the reach of an "iron" golf club of conventional length, a distance that is significant compared to the length of the club.

8. A golf ball retriever as defined in claim 1 wherein said extending means defines an extension of said looped structure opening, said looped structure opening and said extension defining a closed opening to surround the golf ball for said holding.

9. A golf ball retriever, comprising:

a looped structure to hold the golf ball for retrieval;

means defining a first opening shaped to receive the head of a golf club;

a first elongated arm between said looped structure and said first opening to extend said looped structure away from the club substantially along the direction of the shaft of the club;

means defining a second opening to receive the golf club; and a second elongated arm between said first opening and said second opening.

10. A golf ball retriever as defined in claim 9 wherein said first and second openings to receive the golf club are substantially in alignment with one another.

11. A golf ball retriever as defined in claim 9 wherein said looped structure defines an opening to receive the golf ball and wherein said opening defined by said looped structure and said first and second openings to receive the golf club are substantially in alignment with one another.

12. A golf ball retriever as defined in claim 9 wherein said second arm is bendable.

13. A golf ball retriever as defined in claim 9 wherein said looped structure, said first and second opening-defining means and said arms are formed integrally.

14. A golf ball retriever as defined in claim 13 wherein said second arm is bendable.

15. A golf ball retriever as defined in claim 9 wherein said arms are formed of semi-rigid material.

16. A golf ball retriever as defined claim 9 wherein said structure defining said second opening is shaped to receive the shaft of the golf club.

17. A golf ball retriever as defined in claim 9 wherein said opening shaped to receive the head of the golf club is oriented through said structure defining said opening in substantially the same direction as the opening defined by said looped structure.

18. A golf ball retriever as defined in claim 9 wherein said first and second openings to receive the golf club are oriented through said structures defining said openings in substantially the same direction as the opening defined by said looped structure.

19. A golf ball retriever as defined in claim 9 wherein said first elongated arm is formed to extend the reach of an "iron" golf club of conventional length, a distance that is significant compared to the length of the club.

* * * * *

UNITED STATES PATENT AND TRADEMARK OFFICE

CERTIFICATE OF CORRECTION

PATENT NO. : 4,515,402

DATED : MAY 7, 1985

INVENTOR(S) : JACK D. SEDAN

It is certified that error appears in the above-identified patent and that said Letters Patent are hereby corrected as shown below:

Column 4, line 50, "long" should be --along--;

Signed and Sealed this

*Third* Day of *September 1985*

[SEAL]

*Attest:*

DONALD J. QUIGG

*Attesting Officer* *Acting Commissioner of Patents and Trademarks - Designate*